US007367617B1

(12) United States Patent
Bond et al.

(10) Patent No.: US 7,367,617 B1
(45) Date of Patent: May 6, 2008

(54) COLLAPSIBLE POCKET CHAIR

(76) Inventors: Barry Bond, 2304 E. 17th St., Farmington, NM (US) 87401; Ray Valdez, 25 Road 5415, Bloomfield, NM (US) 87413

( * ) Notice: Subject to any disclaimer, the term of this patent is extended or adjusted under 35 U.S.C. 154(b) by 147 days.

(21) Appl. No.: 11/326,880

(22) Filed: Jan. 5, 2006

(51) Int. Cl.
*A47C 4/28* (2006.01)

(52) U.S. Cl. ..... 297/16.2; 297/45; 248/431

(58) Field of Classification Search ..... 297/16.1, 297/16.2, 45; 108/23, 118, 139, 147.21; 248/163.1, 164, 222.52, 425, 431, 436
See application file for complete search history.

(56) References Cited

U.S. PATENT DOCUMENTS

| | | | | | |
|---|---|---|---|---|---|
| 32,698 | A | * | 7/1861 | Johnson | 108/118 |
| 615,476 | A | * | 12/1898 | Chapman | 108/118 |
| 772,316 | A | * | 10/1904 | Mock | 108/118 |
| 4,934,638 | A | | 6/1990 | Davis | |
| 5,851,052 | A | * | 12/1998 | Gustafsson | 297/16.2 |
| 5,921,621 | A | * | 7/1999 | Cook et al. | 297/16.2 |
| 6,871,905 | B2 | | 3/2005 | Grace | |

* cited by examiner

*Primary Examiner*—Peter R. Brown
(74) *Attorney, Agent, or Firm*—Vidal A. Oaxaca; Peacock Myers, P.C.

(57) ABSTRACT

The present invention provides a collapsible, portable, tripod chair.

13 Claims, 5 Drawing Sheets

COLLAPSIBLE POCKET CHAIR

CROSS-REFERENCE TO RELATED APPLICATIONS

Not Applicable.

BACKGROUND OF THE INVENTION

1. Field of the Invention (Technical Field)

The present invention relates to a collapsible, portable, tripod chair.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Numerous collapsible and easily transportable chairs and stools are known for use during outdoor activities or spectator activities. A fairly common design incorporates a tripod leg configuration in which the three legs are joined at their center and over which a flexible material spans the tops of the three legs to form a seat.

Examples of such seats include the collapsible seat of U.S. Pat. No. 6,871,905 is designed to provide increased ground support to prevent instability of the seat in, for example, soft soil, and to provide for an increased, load carrying capacity. The stool of U.S. Pat. No. 4,934,638 is designed to be reduced to a small size when not in use by using telescoping legs and to provide good stability by minimizing the movement of the legs with respect to each other.

However, the chairs of the prior art do not provide for the light weight and small size necessary for easy portability during extended periods of time such as during backpacking expeditions or during long days at amusement parks where standing in line is common. Designs that provide for small size and light weight compromise strength and stability.

Therefore, there is a need for a chair that is easily portable, light, and strong.

BRIEF SUMMARY OF THE INVENTION

The present invention provides a light and strong chair that is easily collapsible to a small size when not in use. An embodiment of the chair comprises a center connector having a hexagonal, transverse cross-section, three leg assemblies, each leg assembly comprising a swivel connector, a lower leg section removably inserted from one end into a first end of the swivel connector, an upper leg section removably inserted from a first end into a second end of the swivel connector, and a fastener to connect the swivel connector to the center connector so that the swivel connector can rotate about the center connector, and a seat portion attached to a second end of each upper leg section, wherein the chair is collapsible by removing the lower leg section, the upper leg section, or both from the swivel connector.

The chair may further comprise a strap secured to the upper leg section, the lower leg section, or both and attachable to the fastener to secure the upper leg section, the lower leg section, or both to the swivel connector. The fastener may secure the swivel connector to the upper leg section or the lower leg section. The center connector is preferably solid.

The swivel connector preferably comprises at least one generally flat face to abut against the center connector. The fastener may comprise a screw. The chair may further comprise a washer disposed on the fastener. The chair may further comprise at least one fastener securing the seat portion to the upper leg section. The chair may further comprise a bundle strap.

The chair may comprise a length when collapsed of from between approximately 60% and 65% of a length of the chair when assembled for use. The chair may comprise a weight of less than approximately 2.5 pounds. The chair may comprise an overall length of from between approximately 13 and 15 inches and a width at its widest point of from between approximately 11 and 13 inches when assembled for use. A width of the chair may be from between approximately 3.0 and 3.5 inches when the chair is collapsed. A length of the chair may be from between approximately 8.5 and 9.5 inches when collapsed.

An object of the present invention is to provide a lightweight chair that collapses to such dimensions that it may be carried in a garment's pocket while maintaining stability and strength when in use.

An advantage of the present invention is the ease of maintaining and repairing the chair in light of the ease with which the chair may be dismantled.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides a collapsible, portable, tripod chair. As used herein, "a" and "an" mean one or more.

An embodiment of the present invention provides a chair having three leg assemblies that form a tripod upon which a seat portion comprising a flexible material, such as, but not limited to, canvas is placed. It is understood that the seat portion may also comprise a rigid material. Each leg assembly comprises three parts: a lower leg section; an upper leg section; and a swivel connector into which the upper and lower leg sections are inserted so that the two sections are joined.

Each swivel connector attaches to a common center connector about which the swivel connector pivots so that the leg assemblies can be deployed into a tripod configuration. The center connector preferably comprises a hexagonal octagonal, transverse cross-section and is preferably solid. Each swivel connector preferably comprises at least one generally flat face so that when the swivel connector abuts against the center connector, stability is enhanced.

A fastener is provided for each swivel connector to attach each swivel connector to the center connector. Preferably, the fastener also attaches either the upper leg section or the lower leg section to the swivel connector, and preferably by being inserted through corresponding leg section, the swivel connector, and the center connector to join all three.

The other, unattached leg section is inserted into the swivel connector when the chair is assembled to be used, and it is removed when the chair is collapsed to be transported or stored. Thus, for each leg assembly, one of the leg sections, the swivel connector, and the center connector form a unit that can be collapsed or extended/deployed to form a tripod.

A cord or strap, preferably an elastic strap, is secured to the inserted leg section and is attachable (i.e., can be anchored) to the fastener from the outside of the leg sections and swivel connector to hold the upper and lower leg sections together for stability. Thus, the fastener provides a tethering point for the strap.

Preferably, the lower leg section is the section that is attached to the swivel connector via the fastener and the upper leg section is the section that is secured with the elastic strap. In such an embodiment, the seat portion may be disposed on each upper leg section. When the chair is not in use, the elastic strap is released from the swivel connector fastener so that the leg assembly can be disassembled to collapse the chair to smaller dimensions than when deployed or, in other words, assembled for use.

Figure 1:
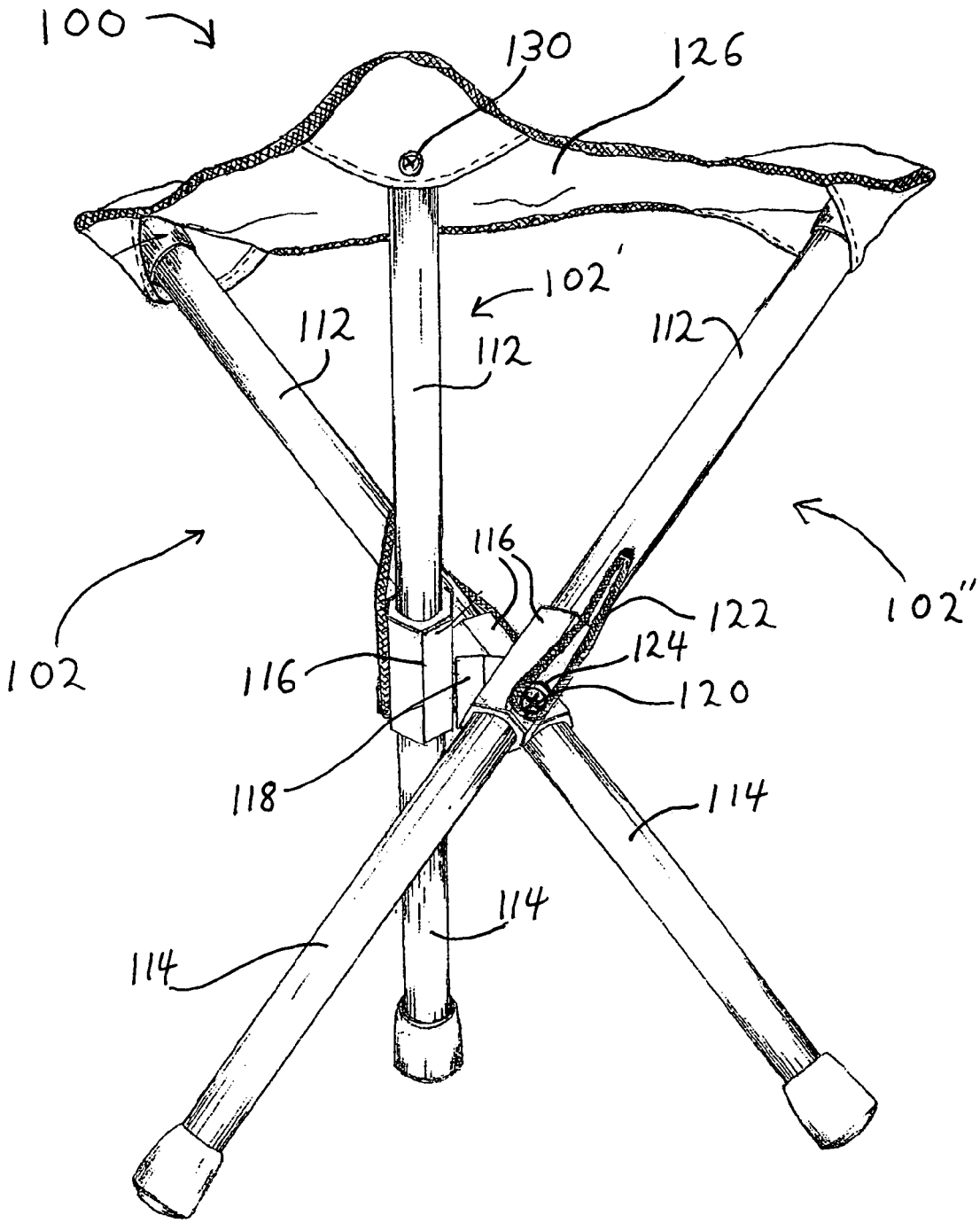
FIG. 1 is a perspective view of an embodiment of the present invention.
Figure 3:
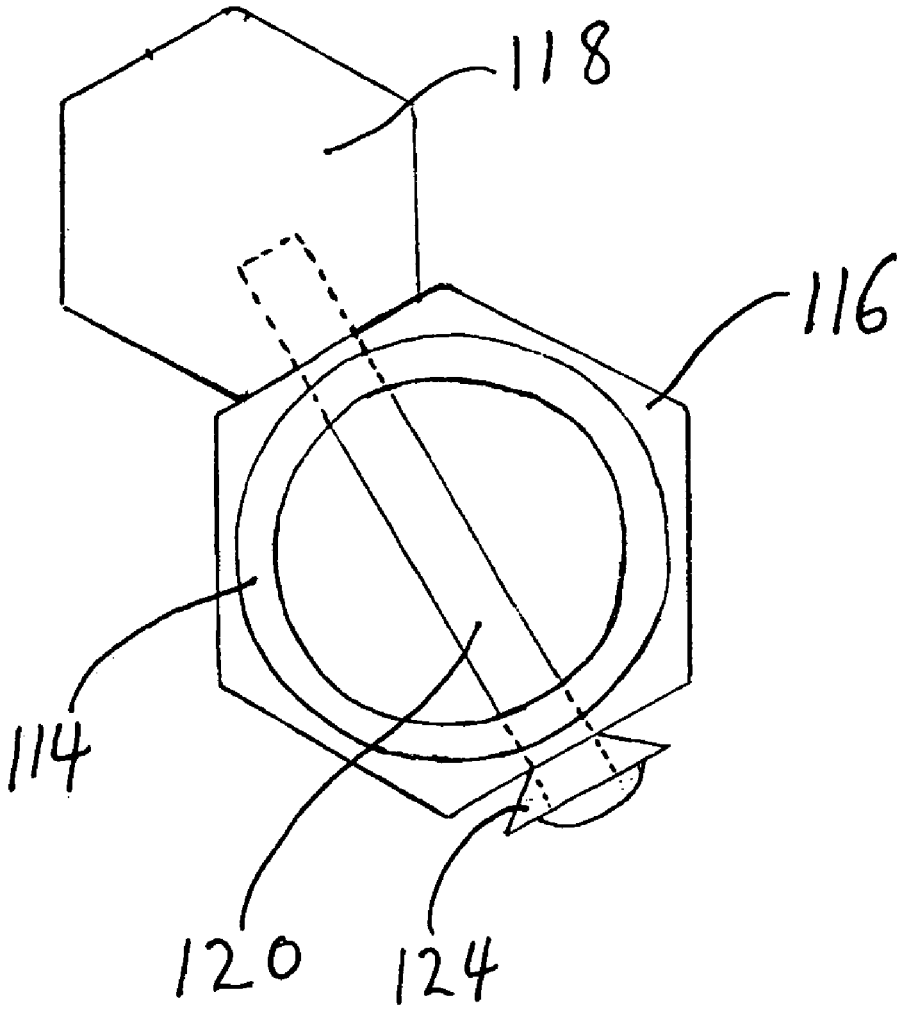
FIG. 3 is a top view of the center connector and a leg assembly of the embodiment of FIG. 1.

Turning now to the figures, which describe the preferred embodiment of the present invention, FIG. 1 show chair 100 comprising three leg assemblies 102, 102', and 102" over which seat 126 is disposed. Seat portion 126 is preferably fastened to each leg assembly via fasteners 130 such as, but not limited to, pins, screws, rivets, adhesives, etc. Each leg assembly comprises an upper leg section 112, a lower leg section 114, and swivel connector 116 into which upper leg section 112 and lower leg section 114 are inserted. Upper leg section 112 and lower leg section 114 are preferably tubular and may comprise a rounded, transverse cross-section. Swivel connector 116 is preferably tubular. Swivel connector 116 is fastened to center connector 118 via a fastener 120. Swivel connector preferably comprises at least one generally flat or planar face 117 to abut against center connector 118, and center connector 118 preferably comprises a hexagonal, transverse cross-section, as is more easily seen in FIG. 3, thereby providing a solid and stable surface for the attachment of swivel connector 116. Center connector 118 is preferably solid. Center connector 118, swivel connector 116, upper leg section 112, and lower leg section 114 comprise any rigid material, preferably a light-weight metal, more preferably aluminum or an aluminum alloy.

Figure 2:
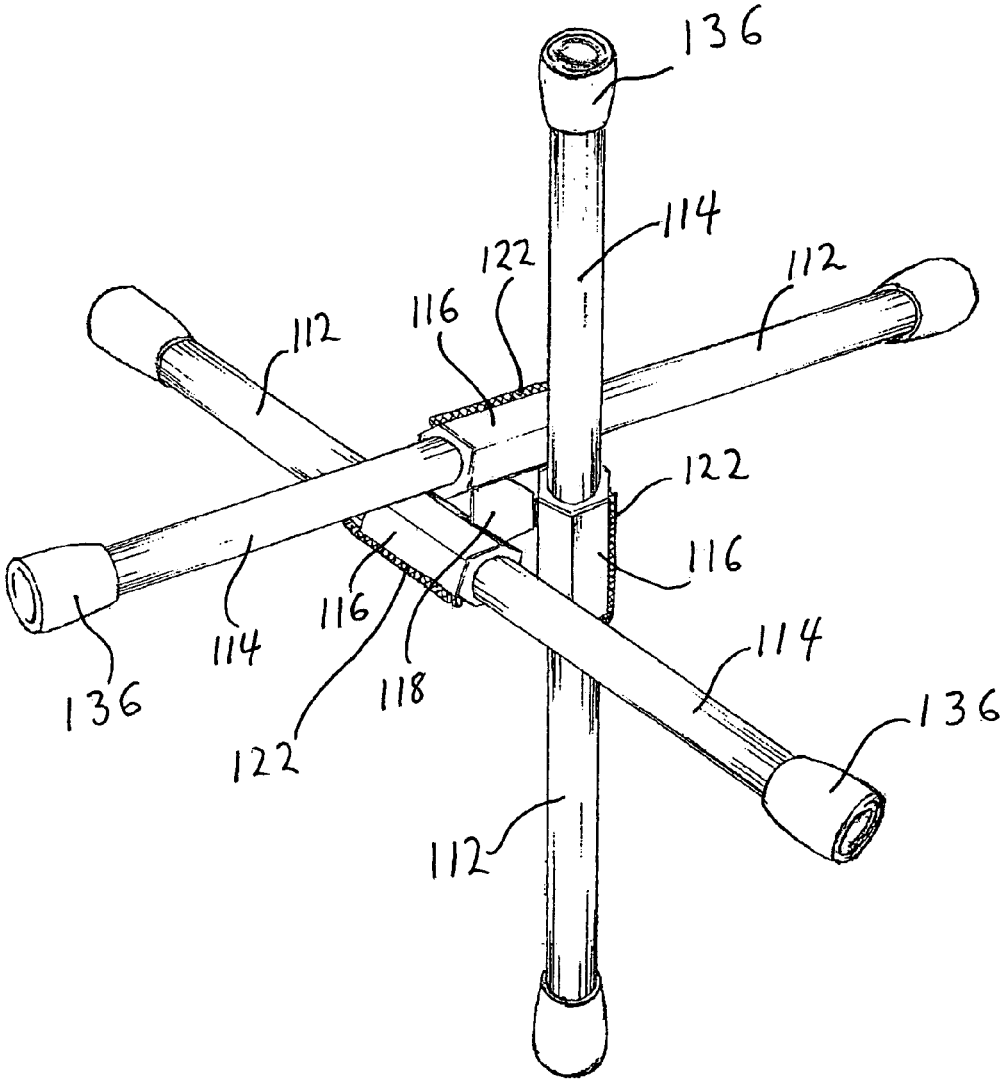
FIG. 2 is a bottom view of the embodiment of FIG. 1 without the top, flexible material.

Fastener 120 may comprise a screw, a pin, or any type fastener known in the art capable of connecting swivel connector 116 to center connector 118. Preferably, as shown in FIG. 2, fastener 120 extends through swivel connector 116, through lower leg section 114, and into center connector 118 to form one unit. Preferably fastener 120 comprises a screw that secures washer 124 against swivel connector 116 to provide an anchoring or tethering point for strap 122 so that upper leg section 112 is secured to swivel connector 116. Washer 124 may be beveled. Alternatively, the exposed portion of fastener 120 may be beveled for easier attachment of strap 122; in such an embodiment, washer 124 may be omitted. Preferably, each strap 122 is secured to upper leg section 112 and extends along the outside of each leg assembly 102, 102', and 102" to secure to the outer/exposed part of fastener 120. In this manner, strap 122 is easily releasable so that upper leg section 112 and lower leg section 118 may be separated for ease in maintaining, cleaning, repairing, replacing, etc. those components.

FIG. 2 is a bottom view of the embodiment shown in FIG. 1, without seat portion 126. Rubber feet 136 may be attached to lower leg sections 114 for stability.

Figure 4:
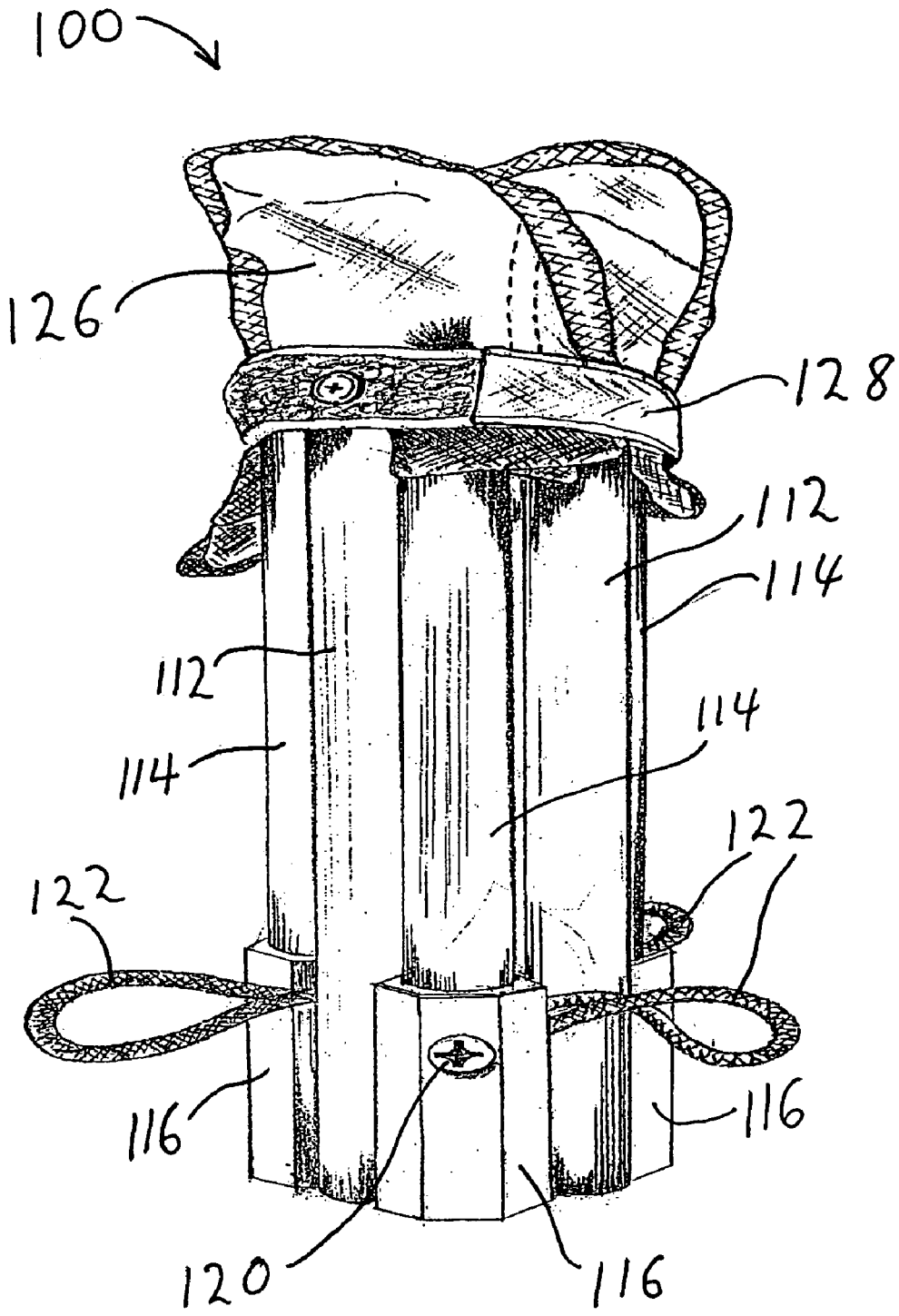
FIG. 4 is a perspective view of the embodiment of FIG. 1 in its collapsed configuration.
Figure 5:
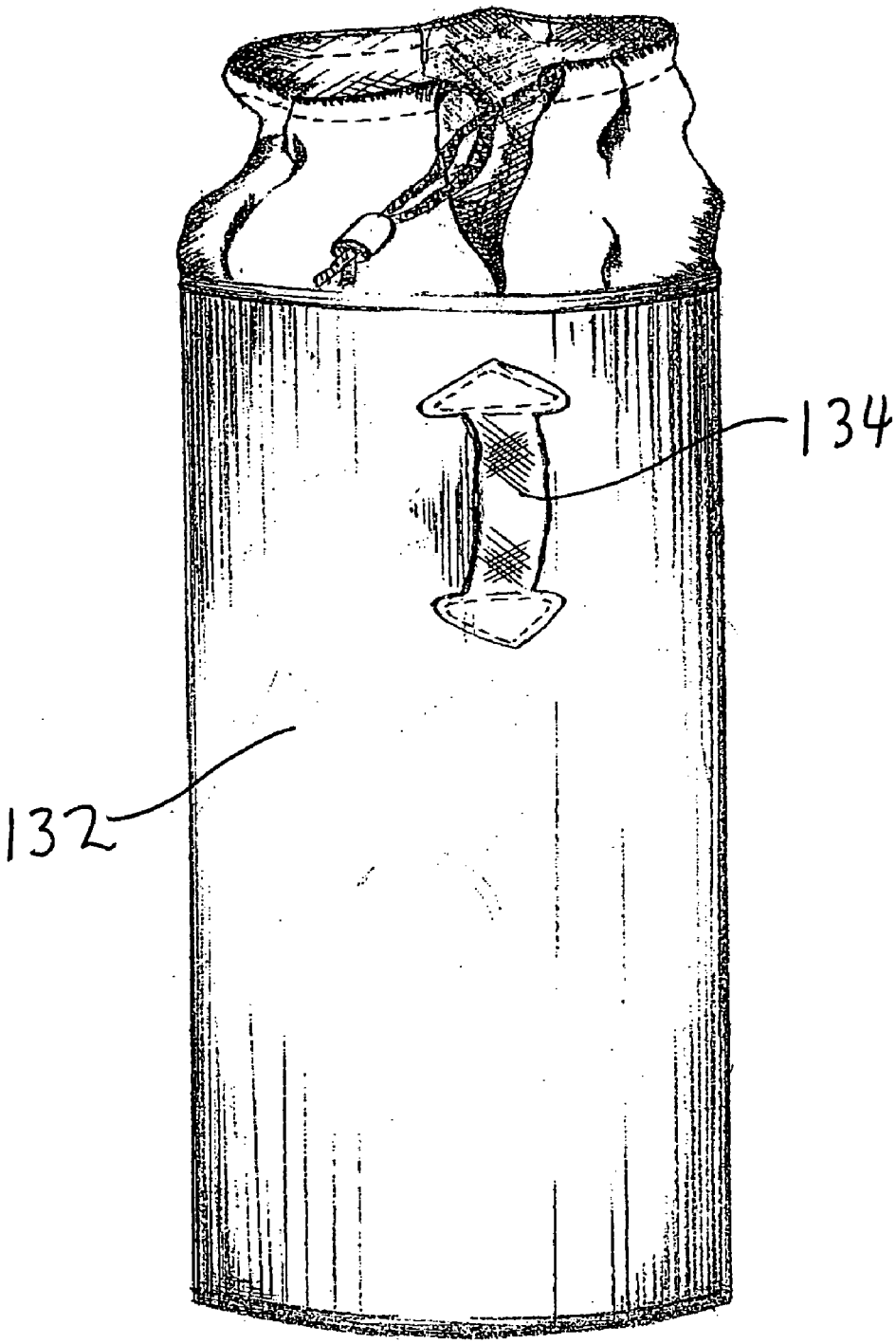
FIG. 5 is a perspective view of the embodiment of FIG. 1 in its stored configuration.

As shown in FIG. 4, bundle strap 128 is preferably provided to help hold the chair components together when chair 100 is disassembled for transporting or storage FIG. 4. As shown in FIG. 5, carrying case 132, with belt (not shown) or belt loop 134, may be provided to hold disassembled chair 100 for ease in transport and storage.

In the preferred embodiment, when collapsed, chair 100 has a length of from approximately 60% to 65% of its length when assembled for use. Preferably, chair 100 weighs less than approximately 2.5 pounds, and more preferably approximately 2.0 pounds. Preferably, when assembled for use, the overall length of chair 100 is from between approximately 13 and 15 inches and its width at its widest point is from between approximately 11 and 13 inches. More preferably, its length is approximately 14 inches and its width is approximately 12 inches. When collapsed the width of chair 100 is preferably from between approximately 3.0 and 3.5 inches, and more preferably approximately 3.5 inches. When collapsed, the length of chair 100 is preferably from between approximately 8.5 and 9.5 inches, and more preferably approximately 9.0 inches.

EXAMPLE

An apparatus in accordance with the description is constructed and used successfully as follows:

1. The upper and lower leg sections, the swivel connectors, and the center connector comprise a light-weight metal.
2. The upper and lower sections are tubular with a round transverse cross-section.
3. The swivel connectors are tubular with a substantially square, transverse cross-section.
4. The center connector is solid with an octagonal, transverse cross-section.
5. The seat comprises a canvas material and is secured to the upper leg sections via fasteners.
6. A screw fastener secures each swivel connector to the corresponding lower leg section and to the center connector. The screw also secures a nylon, beveled washer to which an elastic cord, secured to the upper leg section, is tethered thus securing the upper leg section to the lower leg section.

7. Rubber caps are disposed on the lower end of each lower leg section.
8. A bundle strap is attached to the seat.
9. A nylon carrying case is provided to carry the chair.
10. The length of the assembled chair is approximately 14 inches and its width is approximately 12 inches at its widest point.
11. The weight of the chair and carrying case is approximately 2 pounds.
12. The length of the chair when collapsed is approximately 9 inches and its width is approximately 3.25 inches.

The preceding examples can be repeated with similar success by substituting the generically or specifically described components, biomaterials, devices and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A chair comprising:

a center connector having a hexagonal, transverse cross-section;

three leg assemblies, each said assembly comprising:

a swivel connector;

a lower leg section removably inserted from one end into a first end of said swivel connector;

an upper leg section removably inserted from a first end into a second end of said swivel connector;

a fastener to connect said swivel connector to said center connector so that said swivel connector can rotate about said center connector; and a strap secured to said upper leg section, said lower leg section, or both and attachable to said swivel connector to secure said upper leg section, said lower leg section, or both to said swivel connector; and a seat portion attached to a second end of each upper leg section; and wherein said chair is collapsible by removing said lower leg section, said upper leg section, or both from said swivel connector.

2. The chair of claim 1 wherein said fastener secures said swivel connector to said upper leg section or said lower leg section.

3. The chair of claim 1 wherein said center connector is solid.

4. The chair of claim 1 wherein said swivel connector comprises at least one generally flat face to abut against said center connector.

5. The chair of claim 1 wherein said fastener comprises a screw.

6. The chair of claim 1 further comprising a washer disposed on said fastener.

7. The chair of claim 1 further comprising at least one fastener securing said seat portion to said upper leg section.

8. The chair of claim 1 further comprising a bundle strap.

9. The chair of claim 1 wherein a length of said chair when collapsed is from between approximately 60% and 65% of a length of said chair when assembled for use.

10. The chair of claim 1 comprising a weight of less than approximately 2.5 pounds.

11. The chair of claim 1 comprising an overall length of from between approximately 13 and 15 inches and a width at its widest point of from between approximately 11 and 13 inches when assembled for use.

12. The chair of claim 1 wherein a width of said chair is from between approximately 3.0 and 3.5 inches when said chair is collapsed.

13. The chair of claim 1 wherein a length of said chair is from between approximately 8.5 and 9.5 inches when collapsed.

* * * * *